US010112281B2

(12) United States Patent
Rose et al.

(10) Patent No.: US 10,112,281 B2
(45) Date of Patent: Oct. 30, 2018

(54) COMPONENT BLENDING TOOL

(71) Applicant: United Technologies Corporation, Hartford, CT (US)

(72) Inventors: William M. Rose, West Brookfield, MA (US); John P. Arrigoni, Wallingford, CT (US)

(73) Assignee: United Technologies Corporation, Farmington, CT (US)

( * ) Notice: Subject to any disclaimer, the term of this patent is extended or adjusted under 35 U.S.C. 154(b) by 820 days.

(21) Appl. No.: 14/542,063

(22) Filed: Nov. 14, 2014

(65) Prior Publication Data

US 2015/0147528 A1 May 28, 2015

Related U.S. Application Data

(60) Provisional application No. 61/907,667, filed on Nov. 22, 2013.

(51) Int. Cl.
*B24B 21/02* (2006.01)
*B24B 5/40* (2006.01)

(52) U.S. Cl.
CPC ..... *B24B 21/02* (2013.01); *B24B 5/40* (2013.01); *Y10T 428/24479* (2015.01)

(58) Field of Classification Search
CPC .... B24B 21/20; B24B 5/40; Y10T 428/24479
USPC ..... 451/296–311
See application file for complete search history.

(56) References Cited

U.S. PATENT DOCUMENTS 2,139,952 A * 12/1938 Giles ..... B24B 21/04 451/303
2,367,107 A * 1/1945 Emmons ..... B24B 21/00 451/303
2,671,993 A * 3/1954 Jones ..... B24B 21/16 451/303
3,105,413 A 10/1963 Horst et al.
3,324,607 A 6/1967 Niemiec et al.
3,524,284 A * 8/1970 Mears ..... B24B 19/26 451/303
3,800,473 A 4/1974 Levesque et al.
3,800,609 A * 4/1974 Schaller ..... B24B 21/14 451/303
4,038,783 A * 8/1977 Rosenthal ..... B24B 13/065 451/123
4,084,356 A * 4/1978 Brears ..... B24B 21/00 144/355
4,203,261 A * 5/1980 Davies ..... B24B 21/02 451/303
4,286,903 A 9/1981 Eckendorff
4,721,839 A 1/1988 Dzewaltowski et al.
5,148,639 A * 9/1992 Sakai ..... G03G 5/005 399/350
5,276,999 A * 1/1994 Bando ..... B23Q 7/035 451/303
5,437,125 A 8/1995 Barton, II (Continued)

*Primary Examiner* — George Nguyen
(74) *Attorney, Agent, or Firm* — O'Shea Getz P.C.

(57) ABSTRACT

A component blending tool for forming a pre-determined blended area into a component utilizes a belt having a material removing surface that is contoured to mimic a predetermined depth ratio of the blended area. The tool has an interchangeable shoe that contours the belt and forces the belt upon the component until the pre-determined blended area is substantially the same as said blend ratio.

15 Claims, 9 Drawing Sheets

(56) References Cited

U.S. PATENT DOCUMENTS

| | | | | |
|---|---|---|---|---|
| 5,584,752 | A * | 12/1996 | Mizutani | B24B 21/14 451/296 |
| 5,601,474 | A * | 2/1997 | Takahashi | B24B 19/226 451/271 |
| 6,402,600 | B1 | 6/2002 | Besch | |
| 6,848,978 | B2 * | 2/2005 | Mastro | B24B 21/006 451/296 |
| 7,490,788 | B2 * | 2/2009 | Lin | B02C 19/08 241/199.7 |
| 7,662,024 | B2 * | 2/2010 | Bechtold | B24B 13/01 451/11 |
| 8,641,479 | B2 | 2/2014 | Stephenson | |
| 2001/0003701 | A1 * | 6/2001 | Martin, III | B24B 19/12 451/303 |
| 2001/0014577 | A1 * | 8/2001 | Frech | B24B 21/20 451/355 |
| 2003/0199226 | A1 * | 10/2003 | Sommer | B24B 19/226 451/5 |
| 2007/0259608 | A1 * | 11/2007 | Bechtold | B24B 13/01 451/310 |
| 2013/0224028 | A1 | 8/2013 | Korn et al. | |

* cited by examiner

COMPONENT BLENDING TOOL

This application claims priority to U.S. Patent Appln. No. 61/907,667 filed Nov. 22, 2013.

BACKGROUND

The present disclosure relates generally to a component blending tool and more particularly, to a component blending tool having an abrasive belt for creating a blend area in a component.

Gas turbine engines, such as those that power modern commercial and military aircraft, include a compressor section to pressurize a supply of air, a combustor section to burn a hydrocarbon fuel in the presence of the pressurized air, and a turbine section to extract energy from the resultant combustion gases and generate thrust. Such engines may also employ a geared architecture that connects a fan section, forward of the compressor section to the turbine section.

Components of assemblies may include imperfections, such as nicks, dents, scratches, etc. In high-performance assemblies, such as gas turbine engines, imperfections can reduce strength or fatigue life, especially in components that rotate during operation. Component stresses are increased adjacent to imperfections. The increased stress originating at an unrepaired imperfection can become an initiation site for a crack that can propagate until structural failure occurs. Relatively small imperfections, such as imperfections less than 0.010 inches (0.254 mm) deep, are often blended away from the component as oppose to costly scrapping of the component.

Blending away an imperfection involves removing material from an area of the component to eliminate the imperfection. The area of removed material has a width and a depth characterized as a depth ratio. High-performance assemblies may require relatively high depth ratios, greater than 100 to 1 to minimize the abruptness of surface changes due to blending. Such imperfections may also be located on surfaces that are contoured, i.e. not planar, making the blending operation at high depth ratios that much more difficult and expensive to verify.

SUMMARY

A component blending tool for blending a component according to one non-limiting embodiment of the present disclosure includes a shoe having a contour that corresponds to a blend ratio, and a belt having a first surface in slideable contact with the contour and a material removing surface such that said material removing surface is substantially the same as the blend ratio.

In the alternative or additionally thereto, in the foregoing embodiment, the shoe is at least in part made of carbide.

In the alternative or additionally thereto, in the foregoing embodiment, the tool has a graphite tape secured to the shoe and in sliding contact with the belt.

In the alternative or additionally thereto, in the foregoing embodiment, the tool has first and an opposite second end of the shoe, a first transitioning pulley in receipt of the belt at the first end, and a second transitioning pulley in receipt of the belt at the second end.

In the alternative or additionally thereto, in the foregoing embodiment, the tool has a drive pulley that drives the belt, a tension pulley that maintains belt tension, and a transitioning pulley that is orientated between the belt and the shoe.

In the alternative or additionally thereto, in the foregoing embodiment, the tool has an engagement device for releasable engagement to the component, a first rail attached to the engagement device, and a carriage having the drive pulley, the tension pulley, the shoe and the transitioning pulley constructed and arranged to move along the first rail.

In the alternative or additionally thereto, in the foregoing embodiment, the tool has a second rail being parallel to the first rail and attached to the engagement device, and first and second rollers of the carriage constructed and arranged to roll upon the respective first and second rails for guiding movement of the carriage across the component.

In the alternative or additionally thereto, in the foregoing embodiment, the engagement device is a clamp structure for generally positioning the first rail through a bore defined by the face, and wherein the contour is substantially cylindrical having a radius less than a radius of the face.

In the alternative or additionally thereto, in the foregoing embodiment, the tool has a frame positioned above the face, a resilient member engaged to the frame and the shoe, and an adjustment mechanism for moving the shoe toward the face against a biasing force of the resilient member.

In the alternative or additionally thereto, in the foregoing embodiment, the tool has a car engaged to the resilient member and wherein the resilient member spans between the car and the frame and the shoe is removably attached to the car; a drive pulley engaged rotatably to the frame; a tension pulley engaged to the car; and at least one transitioning pulley engaged adjustably to the car with respect to the shoe.

In the alternative or additionally thereto, in the foregoing embodiment, the tool has a base plate engaged to the shoe and detachably engaged to the car; first and second transitioning pulleys of the at least one transitioning pulley engaged rotatably to the base plate; and wherein the shoe spans longitudinally between the first and second transitioning pulleys.

In the alternative or additionally thereto, in the foregoing embodiment, the adjustment mechanism is pivotally connected to the frame.

In the alternative or additionally thereto, in the foregoing embodiment, the engagement device has a suction cup for securing the first rail to the component, and wherein the contour is substantially flat.

In the alternative or additionally thereto, in the foregoing embodiment, a weight of the carriage biases the shoe against the face.

In the alternative or additionally thereto, in the foregoing embodiment, the predetermined depth ratio is a ratio of a diameter of the blended area to a depth of the blended area and wherein the predetermined depth ratio is greater that about 100 to 1.

In the alternative or additionally thereto, in the foregoing embodiment, a depth of the blended area is less than about 0.005 inches (0.127 millimeters) greater than a depth of an imperfection in the component that is removed when providing the blended area.

A component according to another non-limiting embodiment of the present disclosure includes a face; a blended area formed into the face by a belt of a component blending tool; and, wherein the belt adjacent to the face has a contour that mimics a predetermined depth ratio of the blended area.

A method of removing an imperfection from a face of a component according to another non-limiting embodiment of the present disclosure includes the steps of determining a desired depth ratio; choosing a shoe of the component blending tool that corresponds with the depth ratio; mounting the shoe to a car of the component blending tool; and driving a belt across the shoe and against the face to remove material from the component until the desired depth ratio is reached.

In a further embodiment of the foregoing embodiment, the method has the further step of moving the belt across the face in a direction that is substantially normal to the direction of belt movement across the shoe.

In the alternative or additionally thereto, in the foregoing embodiment, the method has the further step of moving the belt across the face in multiple passes wherein each pass removes a depth that is less than the size of abrasive particles secured to the belt.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
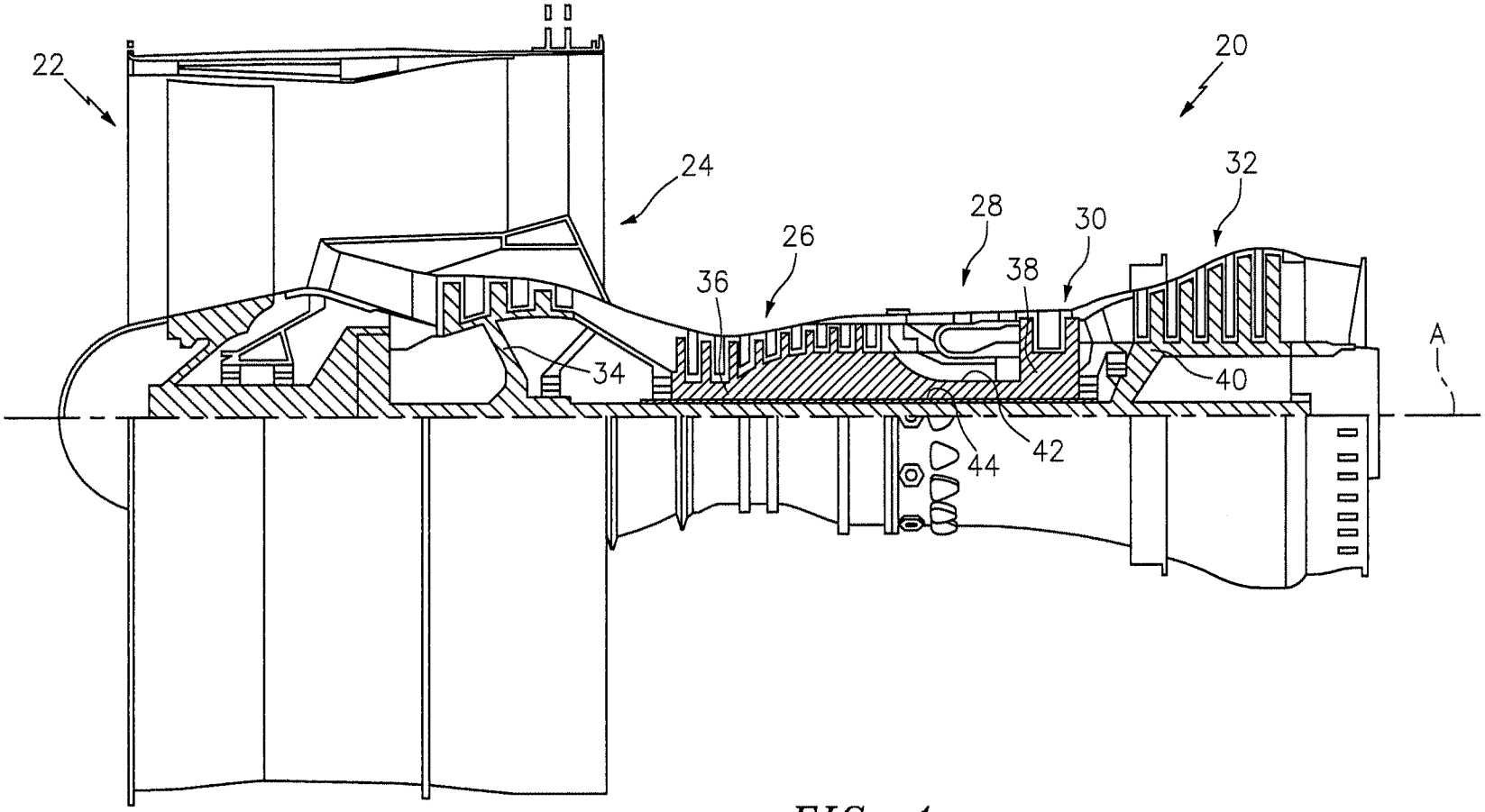
FIG. 1 is a schematic cross-section of a gas turbine engine.
Figure 2:
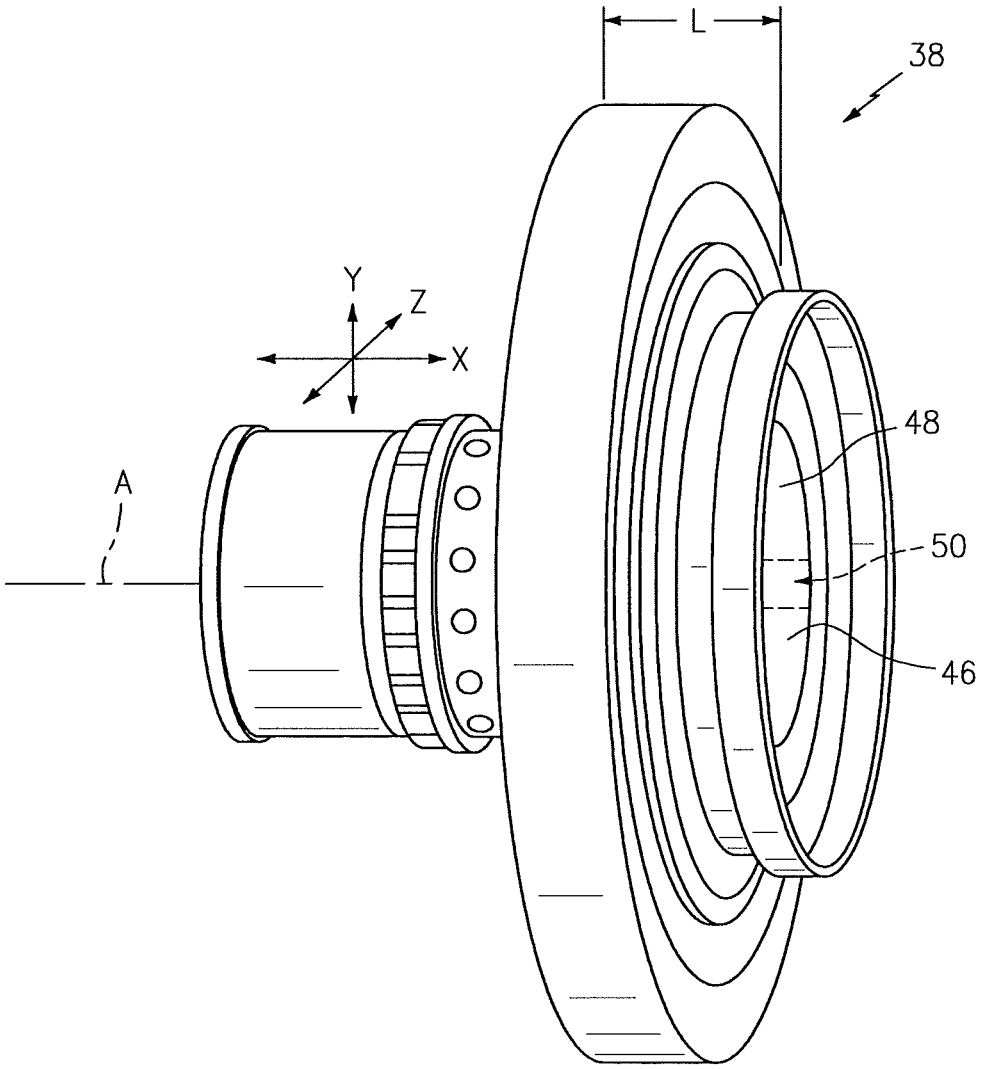
FIG. 2 is a perspective view of a component being a rotor.
Figure 3:
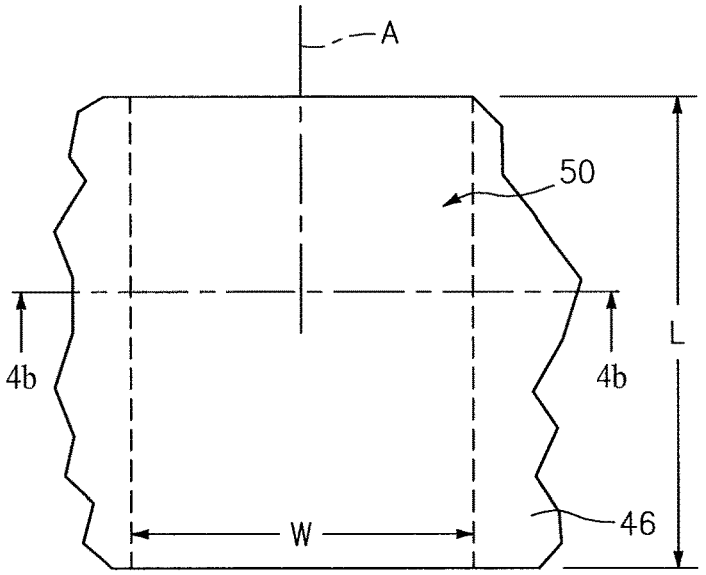
FIG. 3 is a plan view of a portion of a face of the component.
Figure 4A:
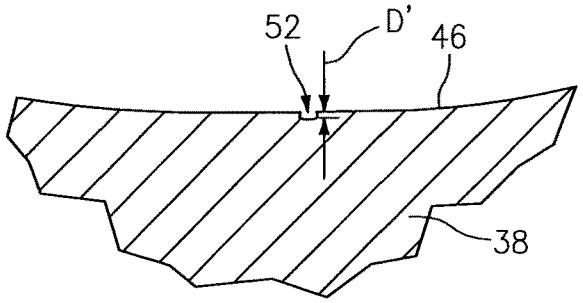
FIG. 4*a* is a partial cross section of the component illustrating an imperfection.
Figure 4B:
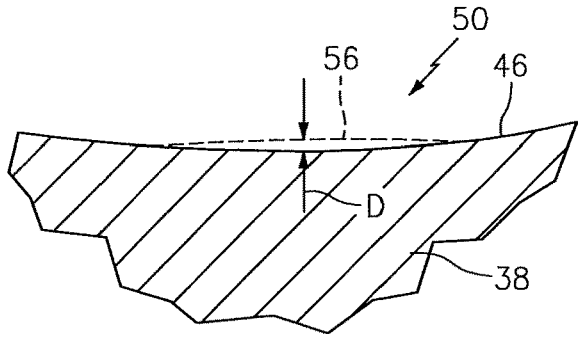
FIG. 4*b* is a partial cross section of the component taken along line 4*b*-4*b* of FIG. 3 and similar to FIG. 4*a* except with the imperfection removed.

Referring to FIG. 1, a turbomachine, such as a gas turbine engine 20, is circumferentially disposed about an axis A. The gas turbine engine 20 includes a fan 22, a low pressure compressor 24, a high pressure compressor 26, a combustor 28, a high pressure turbine 30 and a low pressure turbine 32. Other examples of turbomachines may include more or fewer components or assemblies. Although depicted as a turbofan in the disclosed non-limiting embodiment, it should be understood that the concepts described herein are not limited to use with turbofans as the teachings may be applied to other types of turbine engine architecture such as turbojets, turboshafts, and three-spool (plus fan) turbofans with an intermediate spool.

During operation, air is compressed in the low pressure compressor 24 and the high pressure compressor 26. The compressed air is then mixed with fuel and burned in the combustor 28. The products of combustion are expanded across the high pressure turbine 30 and the low pressure turbine 32 thereby driving the fan 22.

The low and high pressure compressors have respective rotors 34, 36. Likewise, the high and low pressure turbines have respective rotors 38, 40. Each of the rotors 34, 36, 38, 40 include alternating rows of rotatable blades and static stators or vanes. In other aspects, not depicted in FIG. 1, mechanisms are used to create alternating rotating and counter-rotating rotors instead of rotatable blades and static vanes. The turbine rotors 38, 40 rotate in response to the air expansion to rotatably drive rotors 28, 30. The high pressure turbine rotor 38 is coupled to the high pressure compressor rotor 36 via a spool 42, and the low pressure turbine rotor 40 is coupled to the low pressure compressor rotor 34 via a spool 44. The low spool 44 drives the fan 22 directly or through a geared architecture to drive the fan 22 at a lower speed than the low spool 44. An exemplary reduction transmission is an epicyclic transmission, namely a planetary or star gear system.

Referring to FIGS. 2 to 4*b*, the rotor 38 includes a cylindrical face 46 that defines a rotor bore 48 centered to axis A. In the face 46 may be a blended area 50 created when removing an imperfection 52, such as a nick, crack, scratch, etc. The blended area 50 may extend the entire length L of the bore 48. In this example, the blended area 50 also has a 200 to 1 depth ratio. That is, the general width W of the blended area 50 is about 200 times greater than the depth D of the blended area 50. In another example, the width W of the blended area 50 is about 100 times greater that the depth D of the blended area 50. It should also be understood that the depth ratio may be considered a "blend ratio" is some instances.

As one example, the blended area 50 illustrated may be limited to a two dimensional curved profile. That is, the curvature shown is a cross section profile where the cross section lies along an imaginary plane of the Y and Z Cartesian coordinates (see FIG. 2). Therefore, the imaginary plane is normal to the X-axis or axis A. Because the blended area 50 may extend along the entire length L of bore 48 there may be no curved profile in, for instance, a cross section that lies along an imaginary plane containing the Z and X axis where axis A is linear.

The depth D of the blended area 50 relative to the original face 46 is determined based on the depth of the imperfection 52 removed by the blended area 50. In some examples, the depth D of the blended area 50 is less than about 0.005 inches (0.127 millimeters) deeper than the imperfection depth D' (see FIG. 4*a*) that represents the greatest depth of the imperfection 52. In one specific example, the depth D of the blended area 50 is about 0.002 inches (0.0508 millimeters) deeper than the imperfection depth D'.

Figure 5:
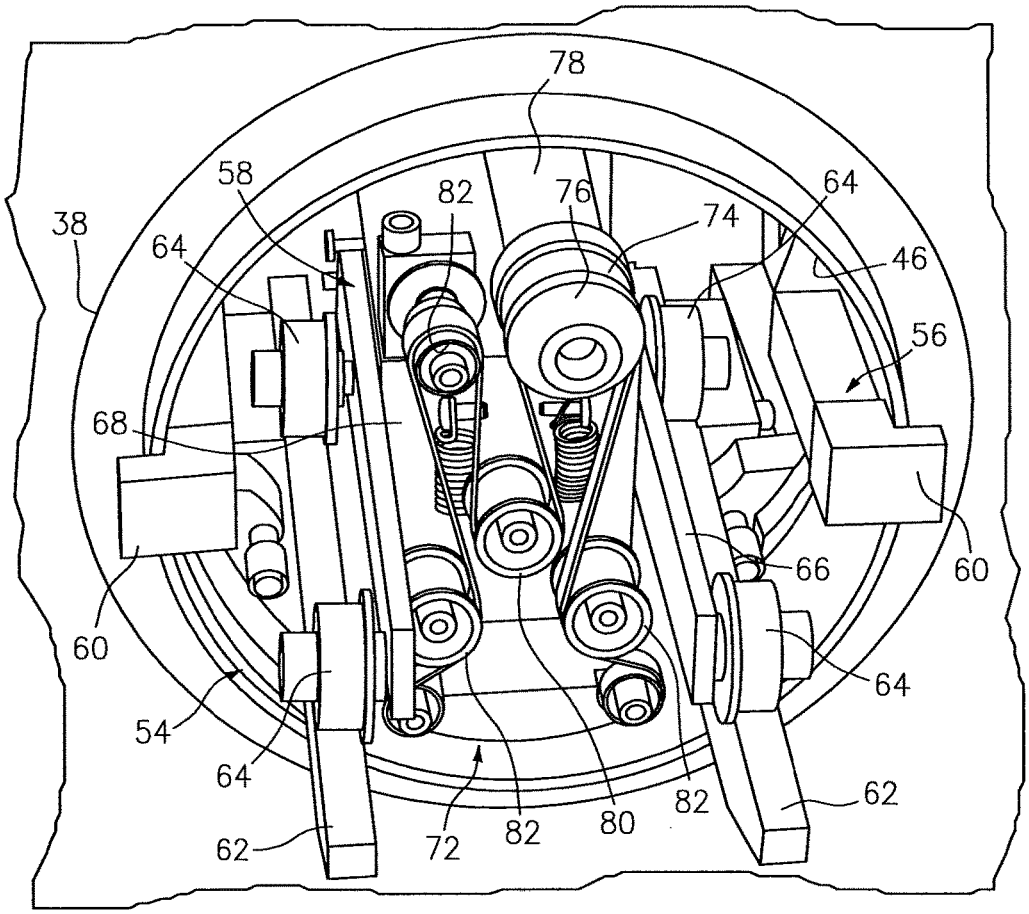
FIG. 5 is a front perspective view of a component blending tool according to one non-limiting embodiment.
Figure 6:
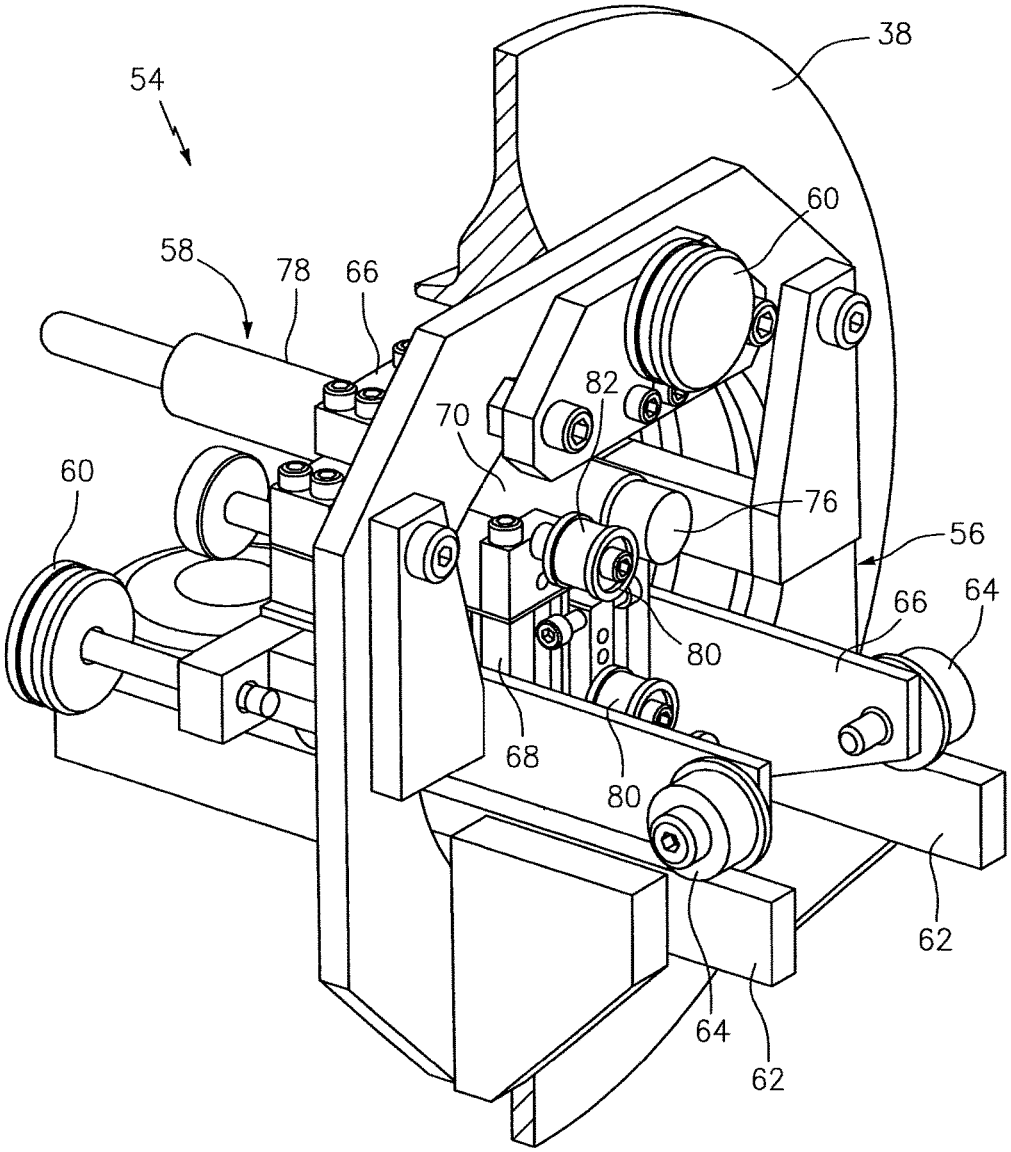
FIG. 6 is a perspective view of the component blending tool with sections removed to show detail.
Figure 7:
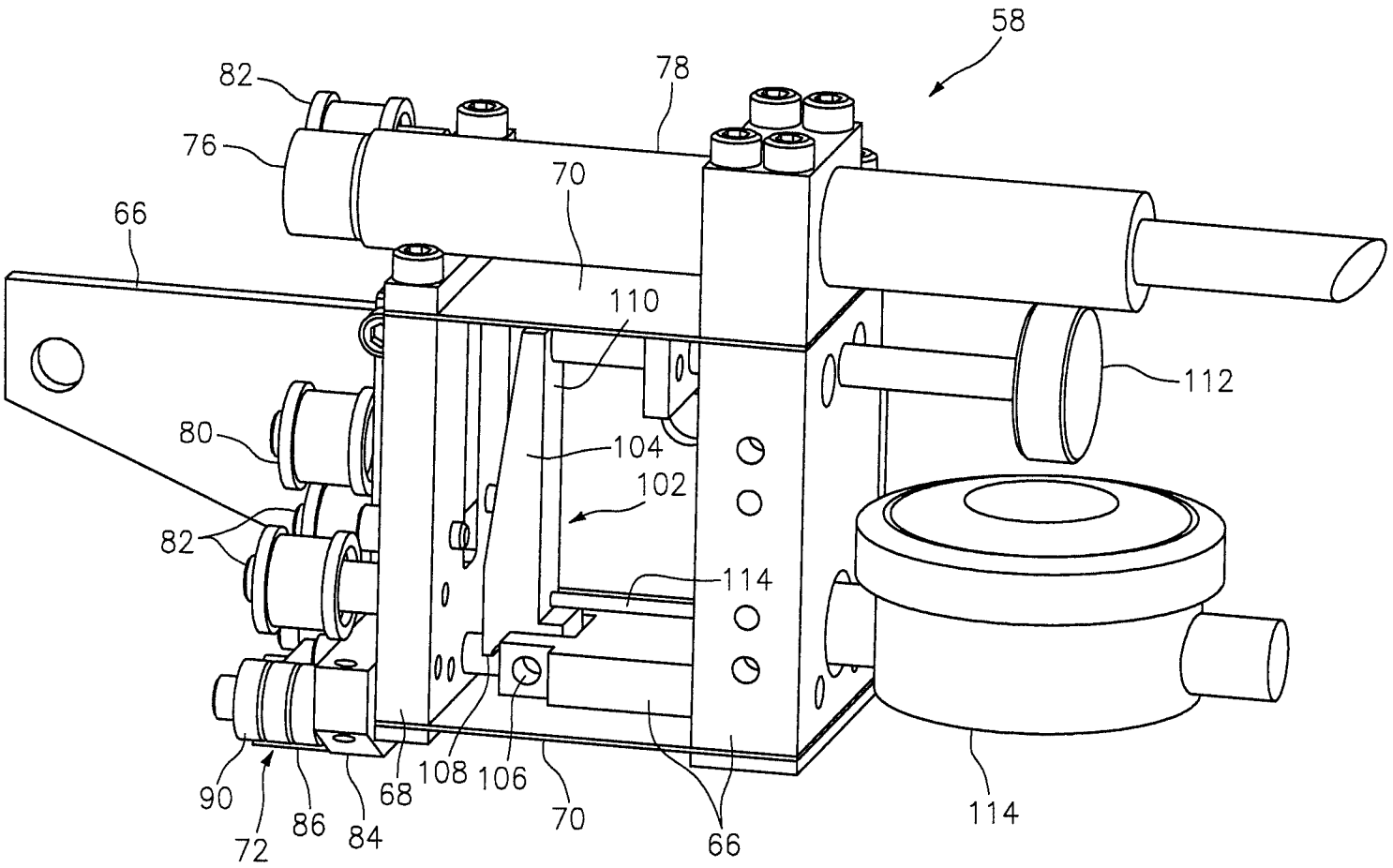
FIG. 7 is a perspective side view of a carriage of the component blending tool with elements removed to show detail.

Referring to FIGS. 5 through 7, a component blending tool 54 used to create the blended area 50 has a static structure 56 and a moving carriage 58. The static structure 56 has an engagement device 60 that may include a plurality of releasable fasteners or clamps that secure to the component or rotor 38. Orientation of the engagement device 60 is dictated by the surrounding structure of the component that carries the face 46 to be blended. As illustrated in one example, the static structure 56 generally resides within or extends through the bore 48 of the rotor 38. Two guide rails 62 of the static structure 56 extend through the bore 48 and are orientated about parallel to the axis A and are spaced from one another such that the blended area 50 is centered below, and co-extends longitudinally to, the two rails 62.

The carriage 58, as illustrated, has two pairs of rollers 64 that rest upon and ride along the respective rails 62, a frame 66 that rotatably supports the rollers 64, a car 68 engaged to the frame 66 by two resilient members 70 (e.g. leaf springs) and a shoe assembly 72 detachably engaged to the car 68 (also see FIG. 7). An abrasive serpentine belt 74 of the carriage 58 rides across the shoe assembly 72 and is driven by a drive pulley 76 and motor 78 secured to the frame 66. A tension pulley 80 and three guide pulleys 82 are rotatably mounted to the car 68 for maintaining a tension upon the belt 74; taking up belt slack in a dense configuration that allows entry of the carriage 58 into the relatively small component bore 48; and, for guiding the belt smoothly during belt oscillation. The serpentine belt 74 is continuous in the sense that it forms a continuous loop. However, such continuity may be established through splicing of a strap-like abrasive material thereby forming the continuous belt.

Figure 8:
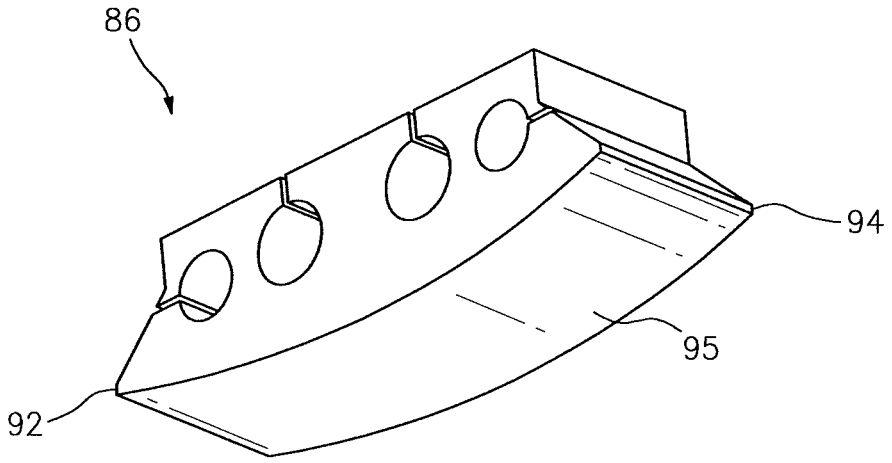
FIG. 8 is a perspective view of a shoe of the component blending tool.
Figure 9:
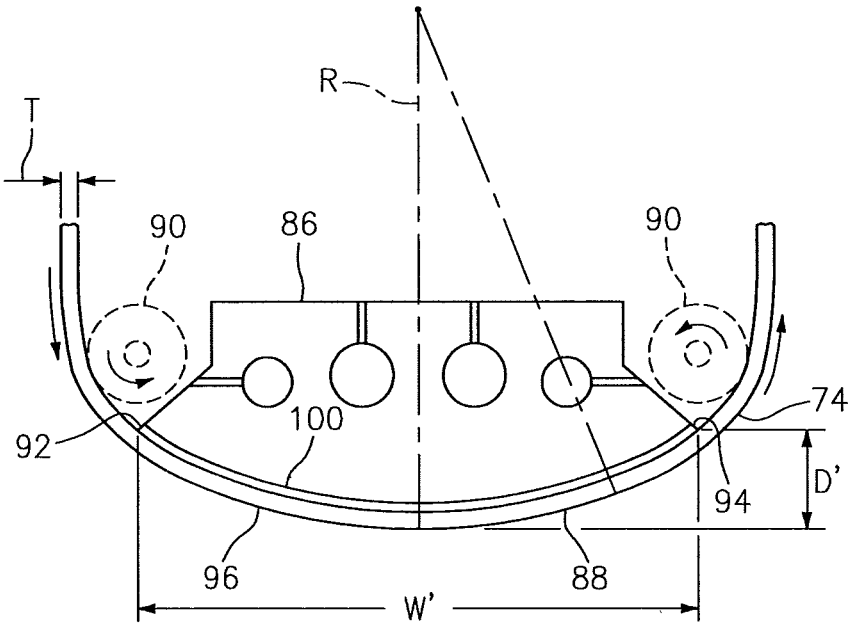
FIG. 9 is a front plan view of a shoe assembly with a belt mounted thereon.

Referring to FIGS. 7 through 9, the shoe assembly 72 includes a base plate 84 engaged detachably to the car 68, a shoe 86 engaged to the base plate 84, and two transitioning pulleys 90 mounted rotatably to the base plate 84 and at respective longitudinal ends 92, 94 of the shoe 86 (i.e. belt entry and exit points of the shoe). The belt 74 carries a material removing surface 88 that faces outward from the shoe as the belt is driven continuously across the shoe from the first end 92 to the second end 94 (i.e. for example respective entry and exit points). A substantially cylindrical contour 95 of the shoe 86 (and taking in consideration the thickness T of the belt 74), forms the substantially cylindrical contour 96 of the material removing surface 88. Notably, the material removing surface contour 96 is the same as the desired contour of the blended area 50. More specifically, a ratio of a width W' of the material removing surface 88 to a depth D' of the material removing surface 88 at the shoe 86 is about 200 to 1. The material removing surface contour 96 thus mimics a desired contour of the blended area 50. The depth D' can thus be represented as a portion of the overall radius R of the cylindrical contour 96 that is taken at mid-span or mid-point between the entry and exit points 92, 94 (see FIG. 9). In the present example, the radius R is substantially constant throughout the length of the shoe; however, it is understood that other non-limiting embodiments may include curving profiles that do not have a constant radius. Such different profiles are dependent upon the operating characteristics and required tolerances of the component being blended.

The desired contour of the blended area 50 has a depth ratio that is predetermined. The predetermined depth ratio is a ratio of a width of the blended area to a depth of the blended area. In this example, a 200 to 1 depth ratio blend, the material removing surface contour 96 corresponds to a cylinder having a calculated radius R that would be slightly smaller than the radius of bore 48. Generally, higher depth ratios are more difficult to achieve and verify than a lower depth ratio, such as a 15 to 1 depth ratio, which is typically allowable for less highly stressed components than a rotor of a turbomachine.

To establish the length L of the blended area 50 (see FIGS. 2 and 3), the carriage 58 is moved back and forth along the rails 62 of the static structure 56 thus performing multiple passes until the desired depth D is achieved. The material removing surface 88 of the belt 74 is pressed upon the face 46 of the rotor or component 38 by a force F that corresponds with the weight of the carriage 58. Therefore, the center of gravity of the carriage 58 is at about the mid-point of the shoe 86 (previously described to determine depth D). More specifically, the entire weight of the carriage 58 may be generally considered to be a concentrated force exerted upon about the mid-point of the shoe 86 and if the carriage were supported at this point, the carriage would remain in substantial equilibrium in any position within at least the Y-Z coordinate plane (see FIG. 2). To minimize the friction between a belt backing or back surface 98 of the belt 74 and the shoe 86, the shoe may be made of a polished carbide material, or alternatively, other friction reducing means may be applied such as the application of a graphite tape 100 (see FIG. 9) to the shoe.

Figure 10:
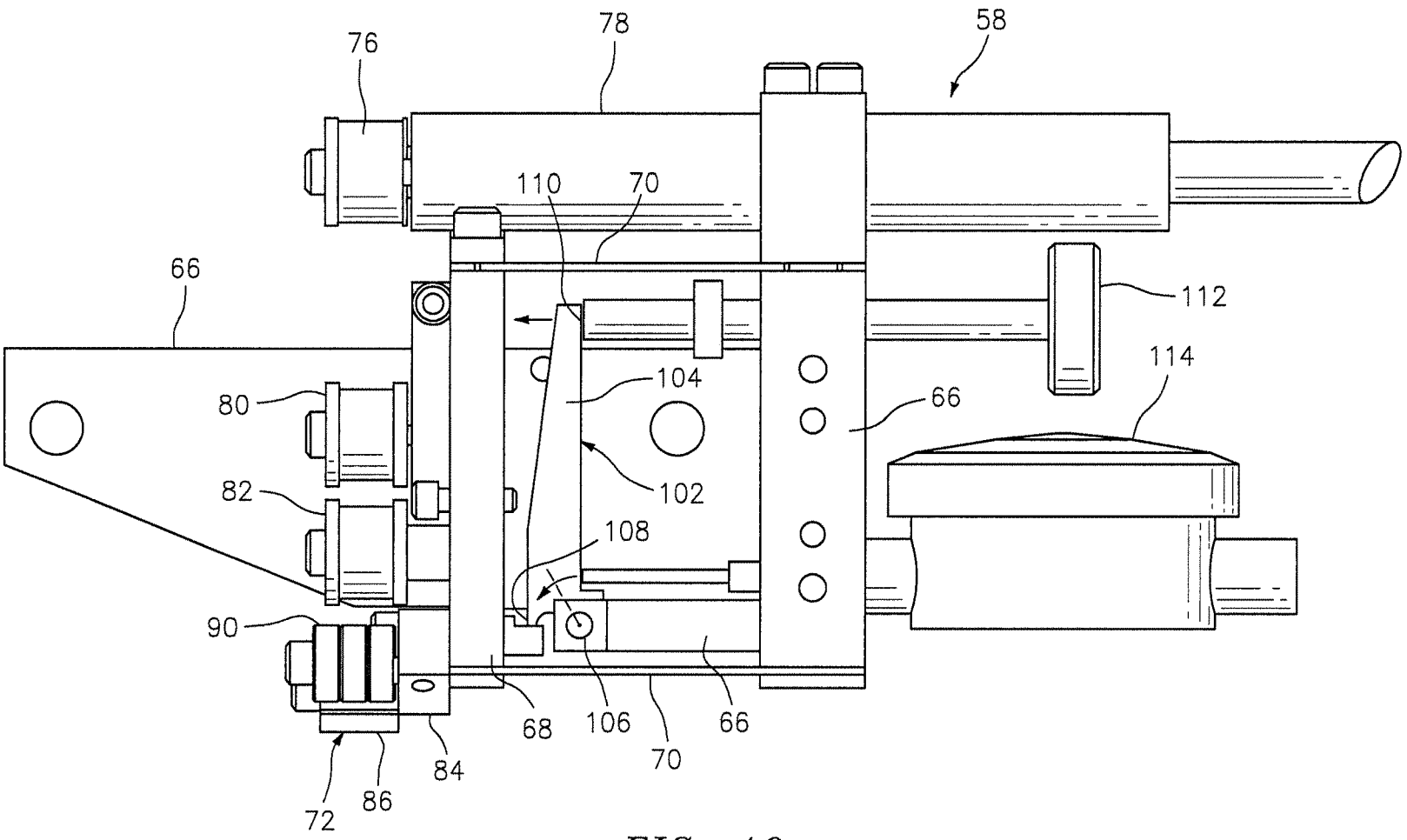
FIG. 10 is a side view of the carriage with components removed to show detail.

Referring to FIGS. 7 and 10, after about each pass of the carriage 58, the carriage is adjusted to move the car 68 and thus the shoe assembly 72 downward by a fraction of the desired depth D. This adjustment is achieved by an adjustment mechanism 102 that operates against the biasing force of the resilient members 70. Mechanism 102 may have a pivoting arm 104 attached pivotally to the frame 66 of the carriage 58. This pivoting connection 106 may be located along the arm generally between a first contact point 108 of the aim that contacts the car 68 and a second contact point 110 of the arm that contacts an adjustment screw 112 threaded into the frame 66. The adjustment mechanism 102 may also include a depth indicator 114 (e.g. distance micrometer) that notifies the user of the distance that the shoe assembly 72 is moved downward (i.e. fraction of depth D).

Figure 11:
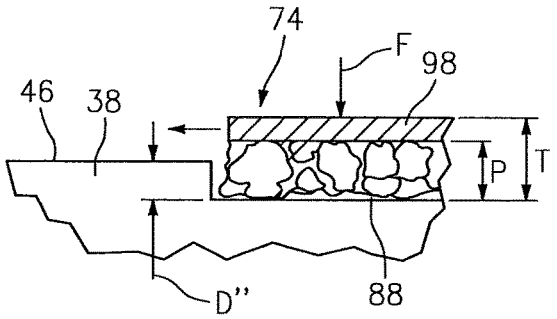
FIG. 11 is a partial cross section of the belt and component.

Referring to FIG. 11, the downward adjustment by mechanism 102 may be limited by the dimensions and composition of the belt 74. That is, the maximum depth D" of each adjustment may be less than the particulate size P of the abrasive material (i.e. thickness of abrasive material) that carries the material removing surface 88. This assures that the edges of the belt 74 and the belt backing 98 are not directly exposed to the grinding action of the tool 54 and thus maximized the life of the belt and prevents unwanted scoring of the component face 46. The abrasive material may be made of a ceramic grain bonded to a cloth or velour backing by a resin material. One such exemplary belt is supplied by Hermes Company (Virginia Beach, Va.) and is identified as an "X-flex" belt.

Figure 12:
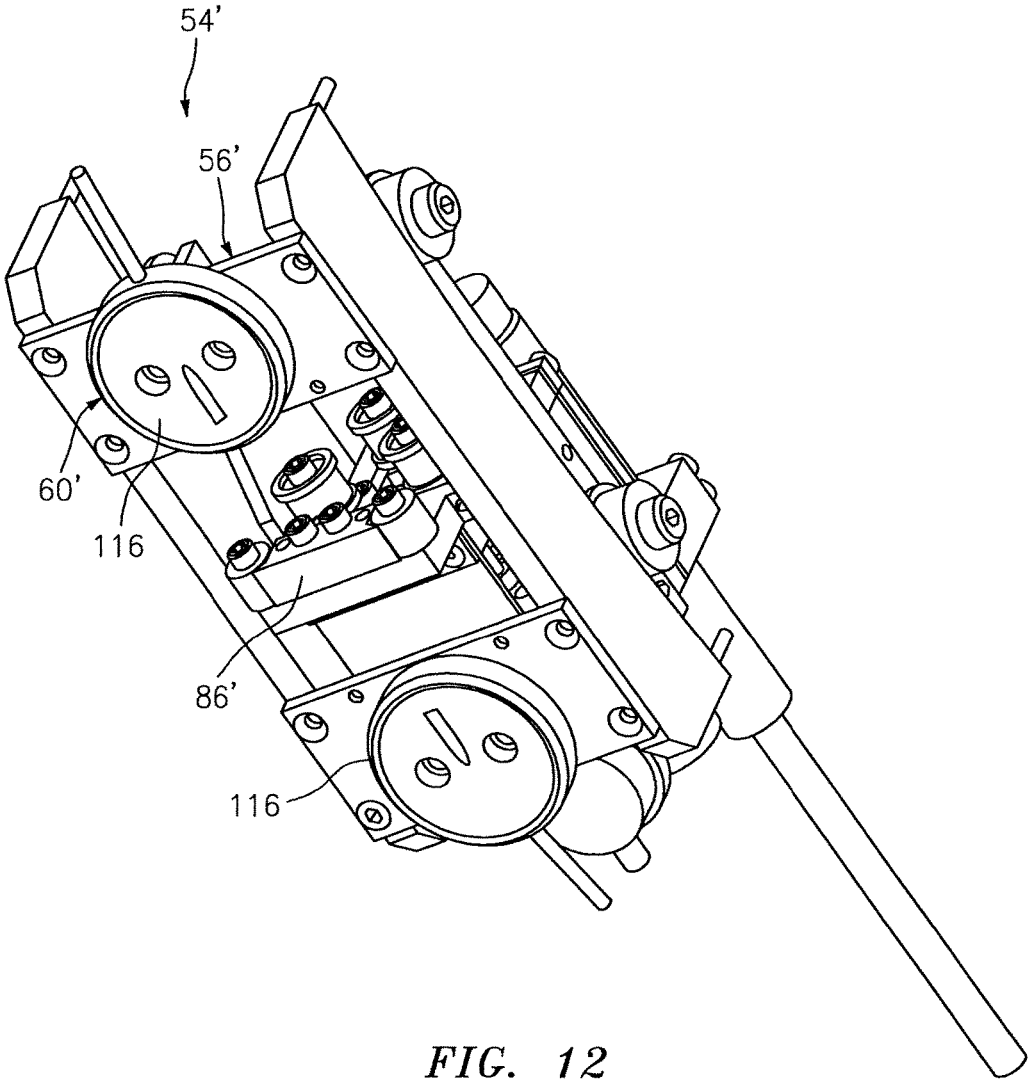
FIG. 12 is a bottom perspective view of a second example of a component blending tool used to create a three dimensional blend (i.e. spherical).

Referring to FIG. 12, another example of the component blending tool to produce a three dimensional blend is illustrated wherein like elements to the previously presented example have like identifying element numbers except with the addition of a prime symbol. In this second example, a component blending tool 54' is useful for blending substantially flat or planar faces of a component. Here, the tool 54' has a static structure 56' having an engagement device 60' that has two suction cups 116 that are pneumatically operative for engagement to the face. The top surfaces of rails 62' may have a radius to partake in producing a 200 to 1 depth ratio spherical blend, both the shoe 86' and the rails 62' will thus have a radius. It is further understood that the contour of the shoe 86' and thus the belt may not have a cylindrical contour as previously described and instead may have any variety of contours (e.g. flat) as dictated by the face geometry and imperfection. Any one of the predetermined blend depth ratios and/or contours can be easily applied by removal of the shoe or shoe assembly from the component blending tool and attachment of another shoe or shoe assembly with an appropriate contour.

It should be understood that relative positional terms such as "forward," "aft," "upper," "lower," "above," "below," and the like are with reference to the normal operational attitude and should not be considered otherwise limiting.

It should be understood that like reference numerals identify corresponding or similar elements throughout the several drawings. It should also be understood that although a particular component arrangement is disclosed in the illustrated embodiment, other arrangements will benefit therefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A component blending tool comprising:

a shoe comprising a contour that corresponds to a blend ratio;

a belt comprising a first surface in slideable contact with the contour and a material removing surface such that said material removing surface is substantially the same as said blend ratio;

the shoe including a first end and an opposite second end;

a first transitioning pulley in receipt of the belt at the first end;

a second transitioning pulley in receipt of the belt at the second end;

a drive pulley for driving the belt;

a tension pulley for maintaining belt tension;

an engagement device for releasable engagement to a component;

a first rail attached to the engagement device; and a carriage including the drive pulley, the tension pulley, the shoe, and the first transitioning pulley and constructed and arranged to move along the first rail.

2. The component blending tool of claim 1 wherein the shoe is at least in part made of carbide.

3. The component blending tool of claim 1 further comprising a graphite tape secured to the shoe and in sliding contact with the belt.

4. The component blending tool of claim 1 wherein a depth of a blended area is less than about 0.005 inches (0.127 millimeters) and greater than a depth of an imperfection in the component that is removed when providing the blended area.

5. The component blending tool of claim 1 further comprising:

a second rail being parallel to the first rail and attached to the engagement device; and first and second rollers of the carriage constructed and arranged to roll upon the respective first and second rails for guiding movement of the carriage across the component.

6. The component blending tool of claim 1 wherein the engagement device is a clamp structure for generally positioning the first rail through a bore defined by a face, and wherein the contour is substantially cylindrical having a radius less than a radius of the face.

7. The component blending tool of claim 1 further comprising:

a frame positioned above a face;

a resilient member engaged to the frame and the shoe; and an adjustment mechanism for moving the shoe toward the face against a biasing force of the resilient member.

8. The component blending tool of claim 7 further comprising:

a car engaged to the resilient member and wherein the resilient member spans between the car and the frame, and the shoe is removably attached to the car;

the drive pulley engaged rotatably to the frame;

the tension pulley engaged to the car; and the first transitioning pulley engaged adjustably to the car with respect to the shoe.

9. The component blending tool of claim 8 further comprising:

a base plate engaged to the shoe and detachably engaged to the car;

the first and second transitioning pulleys engaged rotatably to the base plate; and wherein the shoe spans longitudinally between the first and second transitioning pulleys.

10. The component blending tool of claim 7 wherein the adjustment mechanism is pivotally connected to the frame.

11. The component blending tool of claim 1 wherein the engagement device has a suction cup for securing the first rail to the component, and wherein the contour is substantially flat.

12. The component blending tool of claim 5 wherein a weight of the carriage biases the shoe against a face.

13. A component blending tool comprising:

a shoe comprising a contour that corresponds to a blend ratio;

a belt comprising a first surface in slideable contact with the contour and a material removing surface such that said material removing surface is substantially the same as said blend ratio;

a drive pulley for driving the belt;

a tension pulley for maintaining belt tension;

a transitioning pulley orientated between the belt and the shoe;

an engagement device for releasable engagement to a component;

a first rail attached to the engagement device; and a carriage including the drive pulley, the tension pulley, the shoe, and the transitioning pulley and constructed and arranged to move along the first rail.

14. A component blending tool comprising:

a shoe comprising a contour that corresponds to a blend ratio;

a belt comprising a first surface in slideable contact with the contour and a material removing surface such that said material removing surface is substantially the same as said blend ratio;

a frame positioned above a face;

a resilient member engaged to the frame and the shoe; and an adjustment mechanism for moving the shoe toward the face against a biasing force of the resilient member.

15. The component blending tool of claim 14, further comprising:

a car engaged to the resilient member and wherein the resilient member spans between the car and the frame, and the shoe is removably attached to the car;

a drive pulley engaged rotatably to the frame;

a tension pulley engaged to the car; and at least one transitioning pulley engaged adjustably to the car with respect to the shoe.

* * * * *